US007484642B2

(12) United States Patent
Bonney

(10) Patent No.: US 7,484,642 B2
(45) Date of Patent: Feb. 3, 2009

(54) DISPENSER

(75) Inventor: Stanley George Bonney, Ware (GB)

(73) Assignee: Glaxo Group Limited, Research Triangle Park, NC (US)

( * ) Notice: Subject to any disclaimer, the term of this patent is extended or adjusted under 35 U.S.C. 154(b) by 301 days.

(21) Appl. No.: 10/522,996

(22) PCT Filed: Aug. 4, 2003

(86) PCT No.: PCT/EP03/08647

§ 371 (c)(1),
(2), (4) Date: Feb. 2, 2005

(87) PCT Pub. No.: WO2004/014567

PCT Pub. Date: Feb. 19, 2004

(65) Prior Publication Data

US 2005/0205611 A1 Sep. 22, 2005

(30) Foreign Application Priority Data

Aug. 6, 2002 (GB) ..... 0218251.7
Dec. 18, 2002 (GB) ..... 0229472.6

(51) Int. Cl.
*B05B 11/00* (2006.01)

(52) U.S. Cl. ..... 222/256; 222/340; 222/387; 222/388; 222/380

(58) Field of Classification Search ..... 222/256, 222/340, 383.1, 380, 386–388, 391
See application file for complete search history.

(56) References Cited

U.S. PATENT DOCUMENTS 1,502,066 A * 7/1924 Smith ..... 222/340

(Continued)

FOREIGN PATENT DOCUMENTS

DE 19610456 A1 9/1997

(Continued)

OTHER PUBLICATIONS

Office Action dated Jun. 22, 2007 for U.S. Appl. No. 10/523,053.
Office Action dated Mar. 20, 2008 for U.S. Appl. No. 10/523,053.

*Primary Examiner*—J. Casimer Jacyna
(74) *Attorney, Agent, or Firm*—Dwight S. Walker

(57) ABSTRACT

A dispenser for dispensing a metered volume of a fluid product having a storage chamber for storing the fluid product, an outlet orifice through which the fluid product is dispensable from the dispenser and a metering chamber is disclosed. The metering chamber has an outlet opening which places the metering chamber in fluid communication with the outlet orifice, a transfer opening through which the fluid product is transferable between the storage and metering chambers, and a boundary wall structure which is cyclically movable between a first configuration, in which the transfer opening is opened, and a second configuration, in which the transfer opening is closed. Each cycle of movement which commences at, and ends in, the second configuration results in a metered volume of the fluid product being transferred from the storage chamber to the metering chamber via the transfer opening and dispensed from the outlet orifice via the outlet opening. The dispenser further has an actuation mechanism actuable by a user of the dispenser to cause a cycle of movement of the boundary wall structure. The actuation mechanism is adapted so as to dispose the boundary wall structure in the second configuration at the end of each cycle of movement caused thereby.

37 Claims, 5 Drawing Sheets

U.S. PATENT DOCUMENTS

| | | | | | |
|---|---|---|---|---|---|
| 1,720,890 | A | * | 7/1929 | Fesler | 222/162 |
| 1,757,736 | A | * | 5/1930 | Pritchard | 417/490 |
| 2,174,421 | A | * | 9/1939 | Krannak | 222/80 |
| 2,435,647 | A | * | 2/1948 | Engseth | 92/129 |
| 2,497,762 | A | * | 2/1950 | Davis | 74/104 |
| 2,650,744 | A | * | 9/1953 | Dirksen | 222/383.1 |
| 3,715,062 | A | * | 2/1973 | Todd et al. | 222/340 |
| 3,934,585 | A | | 1/1976 | Maurice | |
| 4,077,494 | A | * | 3/1978 | Spaude et al. | 184/105.2 |
| 4,315,582 | A | | 2/1982 | Micallef | |
| 4,726,747 | A | | 2/1988 | Skorka | |
| 5,024,355 | A | * | 6/1991 | Jouillat et al. | 222/162 |
| 5,033,463 | A | | 7/1991 | Cocozza | |
| 5,207,659 | A | | 5/1993 | Pennaneac'h et al. | |
| 5,226,895 | A | | 7/1993 | Harris | |
| 5,429,122 | A | | 7/1995 | Zanen et al. | |
| 5,453,096 | A | | 9/1995 | Lataix | |
| 5,546,932 | A | | 8/1996 | Galli | |
| 5,568,884 | A | | 10/1996 | Bruna | |
| 5,755,221 | A | | 5/1998 | Bisgaard | |
| 5,765,552 | A | | 6/1998 | Zanen et al. | |
| 6,062,212 | A | | 5/2000 | Davison et al. | |
| 6,505,622 | B2 | | 1/2003 | Py | |
| 7,008,433 | B2 | * | 3/2006 | Voellmicke et al. | 606/93 |

FOREIGN PATENT DOCUMENTS

| | | | | |
|---|---|---|---|---|
| DE | 100 17 438 | | * | 10/2001 |
| EP | 0250922 | A2 | | 1/1988 |
| EP | 0688608 | A1 | | 12/1995 |
| EP | 1066849 | A1 | | 1/2001 |
| FR | 2674747 | A1 | | 10/1992 |
| FR | 2708314 | A1 | | 2/1995 |
| FR | 2815611 | A1 | | 4/2002 |
| FR | 2852934 | A1 | | 10/2004 |
| FR | 2862009 | A1 | | 5/2005 |
| FR | 2862498 | A1 | | 5/2005 |
| GB | 2002847 | A | | 2/1979 |
| GB | 2375960 | A | | 12/2002 |
| WO | 9409912 | A1 | | 5/1994 |
| WO | 0115760 | A1 | | 3/2001 |
| WO | 0205880 | A1 | | 1/2002 |
| WO | 02094708 | A1 | | 11/2002 |
| WO | 02100463 | A1 | | 12/2002 |
| WO | 2005075103 | A1 | | 8/2005 |

* cited by examiner

DISPENSER

This application is filed pursuant to 35 U.S.C. § 371 as a United States National Phase Application of International Patent Application Serial No. PCT/EP2003/008647 filed Aug. 4, 2003, which claims priority from Great Britain Application No. 0218251.7 filed in the United Kingdom on Aug. 6, 2002 and Great Britain Application No. 0229472.6 filed Dec. 18, 2002.

RELATED APPLICATION

This application claims priority from UK patent application Nos. 0218251.7 and 0229472.6, filed respectively on 6 Aug. 2002 and 18 Dec. 2002, the entire contents of which are hereby incorporated herein by reference.

FIELD OF THE INVENTION

The present invention relates to a dispenser for dispensing a metered volume of a fluid product and is particularly, but not exclusively, concerned with a dispenser for dispensing a metered volume of a fluid medicament, for instance medicaments having liquid, gaseous, powder or topical (cream, paste etc.) formulations. The invention also has application in the area of consumer healthcare, as in the case of toothpaste, sun cream lotion etc.

BACKGROUND OF THE INVENTION

Fluid product dispensers having metering mechanisms are known in the art. As an example, in the medical field the use of metered dose inhalers (MDIs) is well established. In a MDI, the fluid product is contained under pressure in a canister having an open end closed off by a valve mechanism. The valve mechanism has a valve body which defines a fixed volume metering chamber through which a valve stem is sealingly slidable between filling and discharging positions. In the filling position, the valve stem places the metering chamber in fluid communication with the canister contents, but isolates the metering chamber from the external environment. Conversely, when the valve stem is moved to the discharge position, the metering chamber is placed in fluid communication with the external environment, but isolated from the canister contents. In this way, a metered volume of fluid product is sequentially transferred to the metering chamber and then discharged to the external environment for inhalation by a patient.

The present invention provides a dispenser for a fluid product having a novel dispensing mechanism.

SUMMARY OF THE INVENTION

According to the present invention there is provided a dispenser for dispensing a metered volume of a fluid product having:

(a) a storage chamber for storing the fluid product;

(b) an outlet orifice through which the fluid product is dispensable from the dispenser;

(c) a metering chamber having:

(i) an outlet opening which places the metering chamber in fluid communication with the outlet orifice;

(ii) a transfer opening through which the fluid product is transferable between the storage and metering chambers; and (iii) a boundary wall structure which is cyclically movable between a first configuration, in which the transfer opening is opened, and a second configuration, in which the transfer opening is closed, each cycle of movement which commences at, and ends in, the second configuration resulting in a metered volume of the fluid product being transferred from the storage chamber to the metering chamber via the transfer opening and dispensed from the outlet orifice via the outlet opening; and (d) an actuation mechanism actuable by a user of the dispenser to cause a cycle of movement of the boundary wall structure, the actuation mechanism adapted so as to dispose the boundary wall structure in the second configuration at the end of each cycle of movement caused thereby.

Preferred features of the invention are set forth in the subordinate claims appended hereto, as well as in the exemplary embodiment hereinafter to be described.

BRIEF DESCRIPTION OF THE DRAWINGS

The FIGURES of drawings are schematic, partial cross-sectional views of a dispenser according to the present invention in which:—

DESCRIPTION OF THE EXEMPLARY EMBODIMENT OF THE INVENTION

Figure 1:
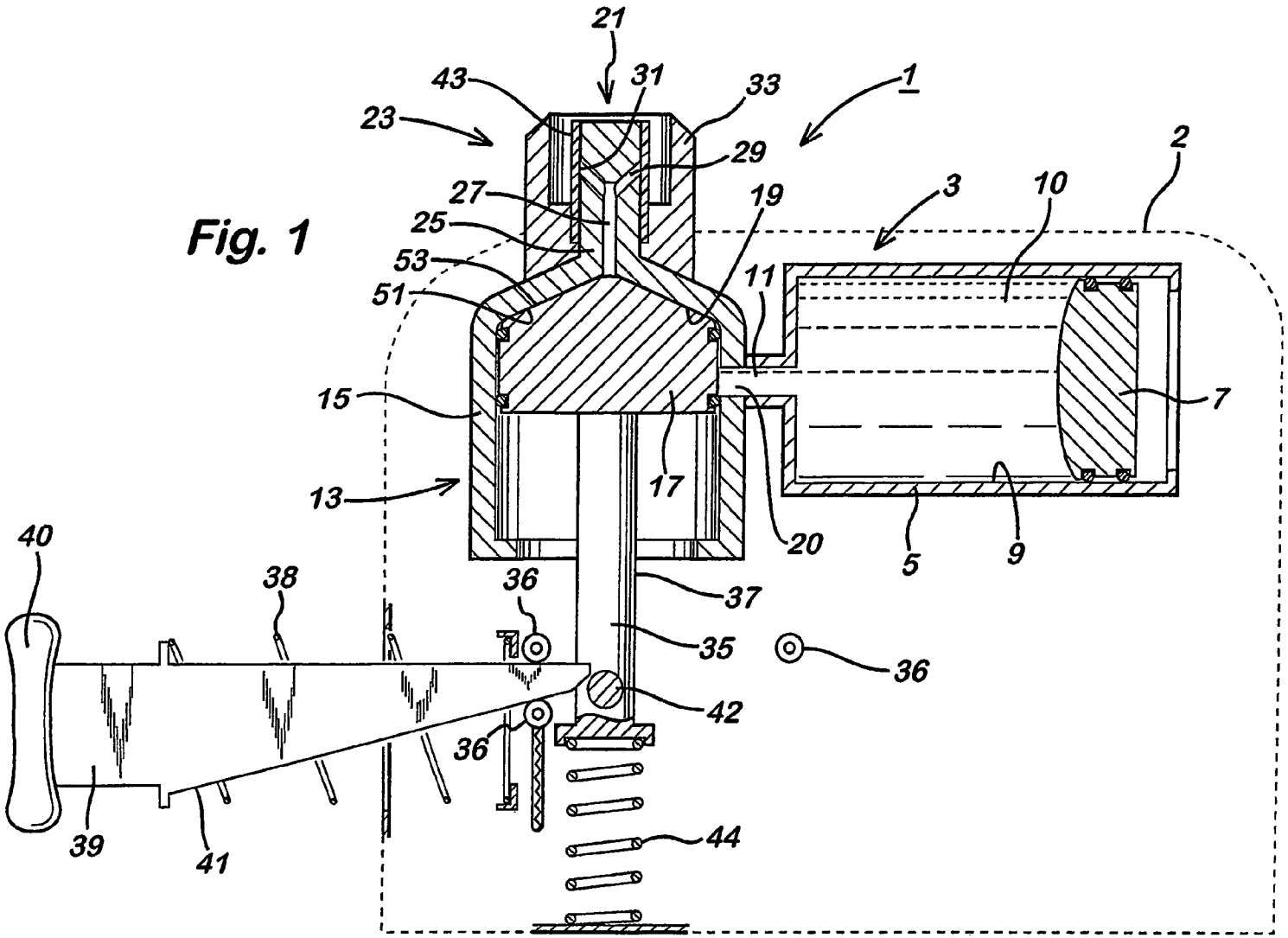
FIG. 1 shows the dispenser in a rest mode.

In the FIGURES a hand-held, hand-operable dispenser 1 according to the present invention is shown. The dispenser 1 may be used as a medicament dispenser, for example as an intranasal delivery device.

The dispenser 1 has a housing 2 which houses a container member 3 comprising a tubular body 5 in which an end wall 7 is sealingly slidable. The inner surfaces of the tubular body 5 and end wall 7 define a storage chamber 9 in which the fluid product 10 to be dispensed, a medicament for instance, is contained. The tubular body 5 has a port 11 at its end opposite to that which receives the sliding end wall 7.

The dispenser 1 further comprises a metering member 13 having a tubular body 15 and an end wall 17 which is sealingly slidable in the tubular body 15. As can be seen from FIG. 2, for example, a metering chamber 19 is defined between the inner surfaces of the tubular body 15 and the end wall 17. As will be described in more detail hereinafter, the metering chamber 19 operates to provide a metered volume of the fluid product 10 for discharge from the dispenser 1.

In a side of the tubular body 15 of the metering member 13 there is provided a port 20 which registers with the port 11 of the container member 3 thereby placing the storage and metering chambers 9, 19 in fluid communication with one another whereby the fluid product 10 can be transferred from the storage chamber 9 to the metering chamber 19 for subsequent discharge from the dispenser 1.

The metering chamber 19 communicates with an outlet orifice 21 of a spray head 23, which, in this embodiment, is shaped and sized for insertion into a user's nostril. The tubular body 15 of the metering member 13 includes an extension 25 through which a narrow channel 27 extends to connect the outlet orifice 21 to the metering chamber 19. The channel 27 has a branched end 29 so as to form an annular outlet port 31 in the outlet orifice 21. The spray head 23 further includes a skirt member 33 mounted on the tubular body 15 about the extension 25 which acts to focus the spray stream discharged through the annular outlet port 31.

The end wall 17 of the metering member 13 forms the head of a spring-loaded plunger member 35 of a hand-operable actuating mechanism of the dispenser 1. The plunger member 35 further has an arm 37 on which a spring 44 acts to bias the plunger member 35 to the rest or return position shown in FIG. 1. The arm 37 is operatively connected to a trigger member 39 of the actuating mechanism, the trigger member 39 having a grip or button 40 for a user of the dispenser 1 to grip with a hand, or press with a finger or thumb, to operate the actuating mechanism. The trigger member 39 is mounted for sliding movement in the dispenser 1 in a direction transverse to the direction of sliding movement of the plunger member 35. In this connection, the dispenser 1 has guides 36 for guiding the sliding movement of the trigger member 39. Moreover, the trigger member 39 is spring-loaded with a spring 38 which biases the trigger member 39 to its extended position shown in FIG. 1.

Figure 2:
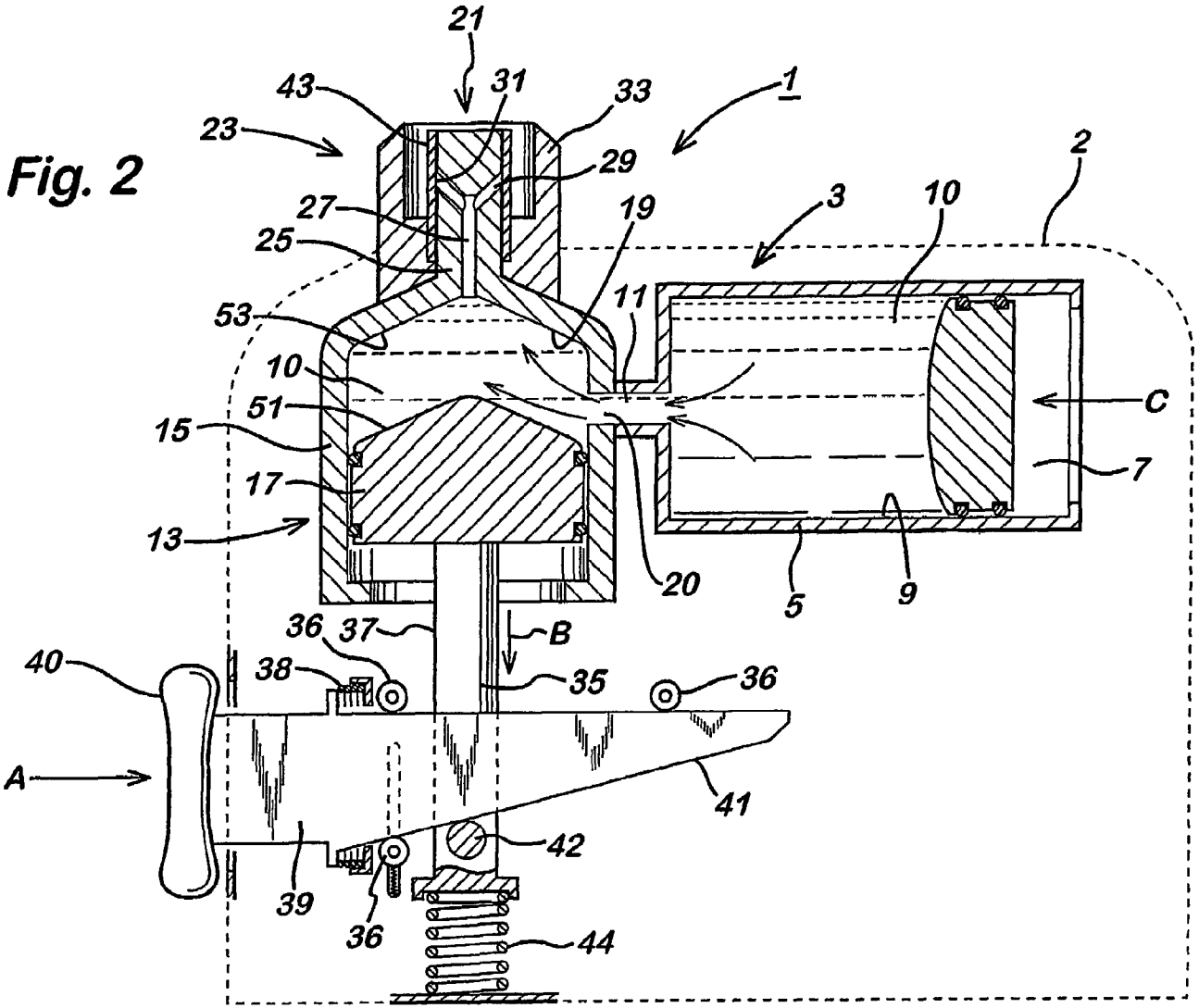
FIG. 2 shows the dispenser in a filling mode of operation.

As will be understood from FIG. 2, the trigger member 39 has a camming surface 41 which, when the trigger member 39 is moved inwardly (arrow A), acts on a cam follower 42 provided on the arm 37 of the plunger member 35 so as to displace the plunger member 35 rearwardly (arrow B) to a primed position, as shown. This is the filling mode of the dispenser 1 in the sense that rearward movement of the plunger member 35 causes a pressure difference between the metering chamber 19 and the storage chamber 9 which causes the end wall 7 of the container member 3 to be displaced inwardly (arrow C) thereby pushing fluid product 10 from the storage chamber 9 into the metering chamber 19 for filling thereof.

A non-return valve 43 is mounted at the outlet orifice 21 about the extension 25 of the tubular body 15 of the metering member 13. The non-return valve 43 is in the form of a sleeve member. The negative pressure created in the metering chamber 19 as the plunger member 35 is retracted from the rest position shown in FIG. 1 causes the valve 43 to be biased to a closed position in which it seals off the annular outlet port 31.

Figure 3:
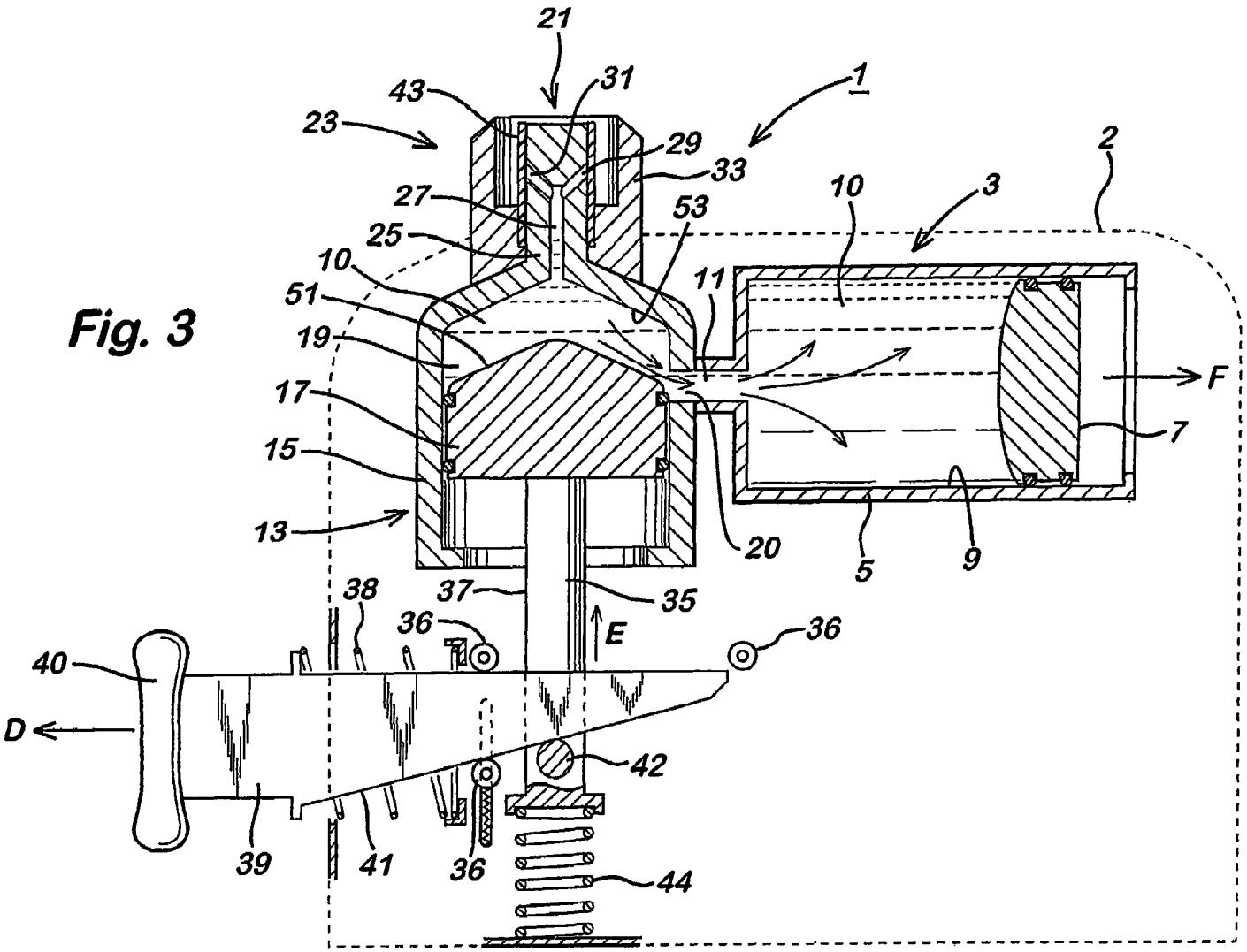
FIGS. 3 to 5 show the dispenser in various stages of a dispensing mode of operation.
Figure 4:
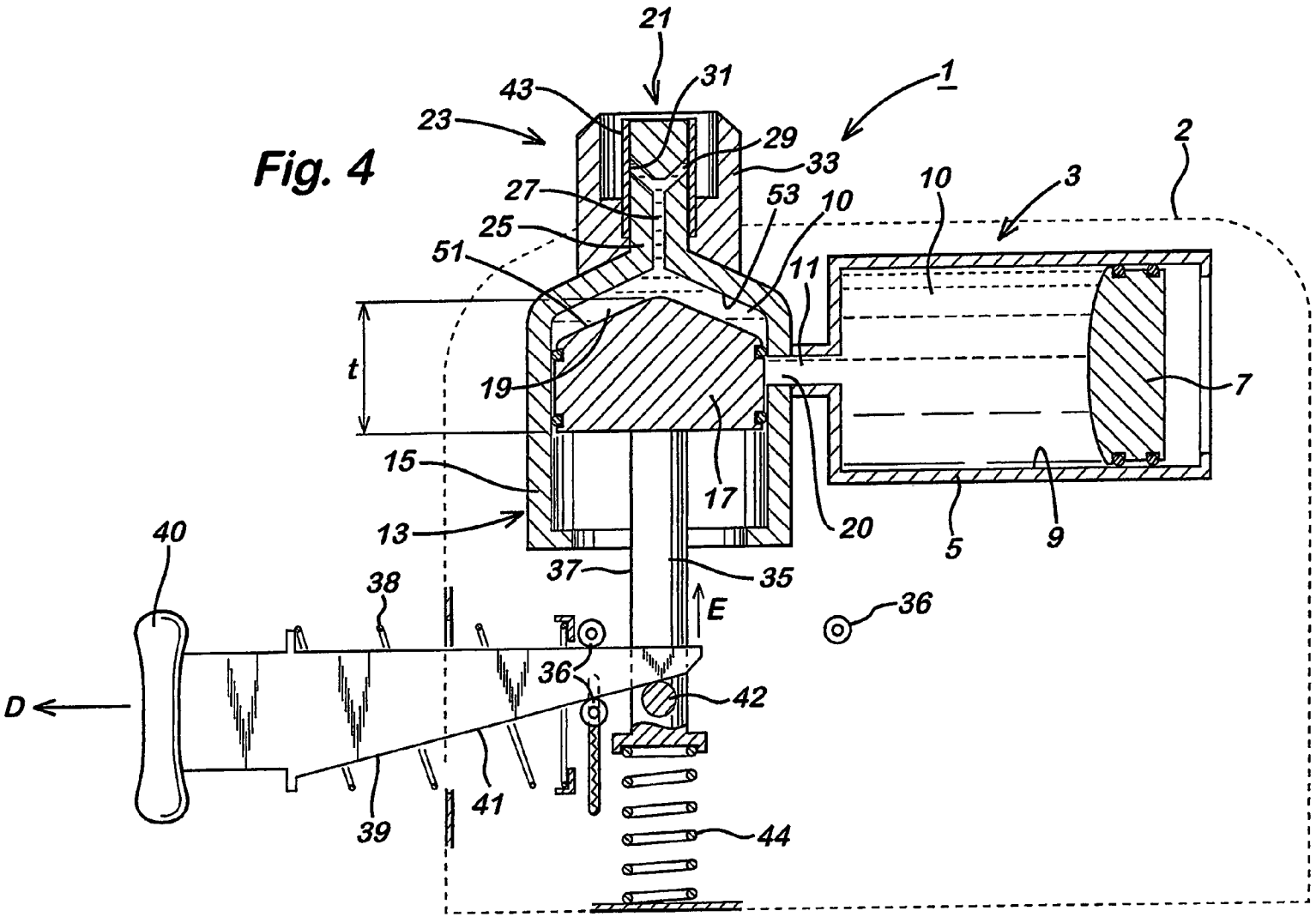
Figure 5:
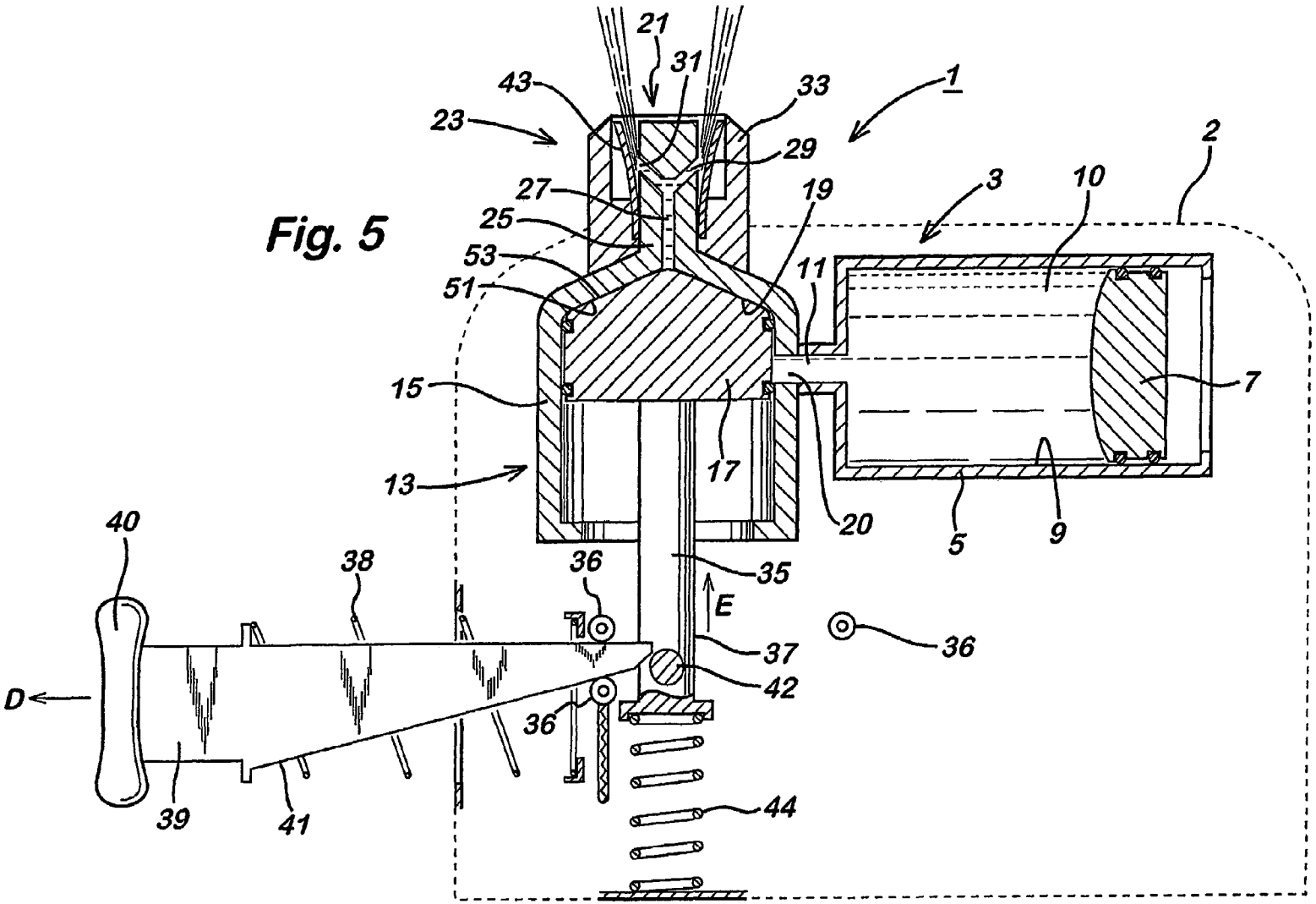

Referring to FIGS. 3 to 5, once the dispenser 1 has been primed, by inward movement of the trigger member 39 causing retraction of the plunger member 35 to the rearwardmost primed position and compression of the springs 38,44, the dispenser 1 can be actuated by releasing the inward force on the trigger member 39. This releases the loading on the spring 38 allowing it to drive the trigger member 39 outwardly (arrow D) whereupon the plunger member 35 is released from capture by the trigger member 39 and driven forwardly by the spring member 44 (arrow E). This is the discharge mode of the dispenser 1.

The initial stage or phase of the discharge mode is shown in FIG. 3. In this initial stage, the forward movement of the plunger member 35 pushes surplus fluid product 10 received in the metering chamber 19 in the filling mode back into the storage chamber 9 through the communicating ports 11, 20. In this regard, the bleeding of the surplus fluid product is accommodated by outward sliding movement of the end wall 7 of the container member 3 (arrow F) responsive to the increase in pressure in the storage chamber 9 as the surplus fluid product is received therein.

As will be understood from FIG. 4, as the plunger member 35 is slid forwardly it reaches an intermediate position at which the plunger head 17 closes off the port 20 thereby sealing the metering chamber 19 from the storage chamber 9. The end wall 7 of the container member 3 is adapted to move outwardly at a lower pressure than the valve 43 thereby ensuring that during movement of the plunger member 35 from its rearwardmost primed position to the intermediate position surplus fluid product is transferred back to the storage chamber 9, not discharged from the outlet orifice 21.

At the intermediate position in the discharge mode of the dispenser 1, shown in FIG. 4, the metering chamber 19 defines a predetermined volume filled with the fluid product 10. This is the "metered volume" of fluid product to be dispensed by the dispenser 1.

As shown in FIG. 5, onward forward movement of the plunger member 35 forces open the valve 43 and causes discharge of the metered volume of the fluid product from the annular outlet port 31 of the outlet orifice 21. The narrow dimensions of the channel 27 and annular outlet port 31 cause the discharged fluid product to be in the form of a spray stream if liquid is being dispensed.

Once the spring member 44 has returned the plunger member 35 to its forwardmost rest position, the pressure pulse which caused the valve 43 to open subsides whereby an inherent bias in the material of the valve 43 biases it back to its closed position over the annular outlet port 31.

As shown in FIGS. 1 and 5, the plunger head 17 has a front face 51 which sealingly closes the channel 27 to the outlet orifice 21 when the plunger member 35 is in the rest position. Moreover, in this embodiment, the front face 51 is of complementary shape to the front section 53 of the metering chamber 19 in which the channel 27 opens. In other words, the front face 51 sealingly engages the front section 53.

As will be seen from FIG. 4, the plunger head 17 has a thickness t which is such that it maintains the port 20 in a closed state as it moves from the intermediate position to the forwardmost position. In this manner, fluid product 10 in the storage chamber 9 is unable to be transferred behind the plunger member 35, nor is fluid product 10 able to drain back from the metering chamber 19 to the storage chamber 9.

It will therefore be understood that a sealed system is achieved since the storage chamber 9 is sealed from the external environment about the dispenser 1.

After the metered volume has been dispensed, the dispenser 1 is left in the rest mode shown in FIG. 1 until such time as another metered volume is required to be dosed.

To refill the metering chamber 19, the trigger member 39 is re-engaged with the plunger member 35 so as to cam the plunger member 35 rearwardly. After the plunger member 35 has passed the intermediate position on its rearward travel, the port 20 is opened whereby the fluid product 10 can be transferred from the storage chamber 9 to the metering chamber 19 in the manner previously described preparatory to dispensing a further metered volume of the fluid product. After each actuation cycle, the volume of the storage chamber 9 decreases commensurate with the diminution of the volume of fluid product, i.e. by the metered volume. This is because during the initial phase of a discharge mode, the end wall 7 of the container member 3 is pushed back to a position closer to the port 11 than that at the start of the filling mode.

The dispenser 1 provides for high accuracy dosing from a sealed system which protects the fluid product 10 from contamination from the external environment. For instance, the non-return valve 43 prevents air ingress. Moreover, the storage chamber 9 is isolated from the outlet orifice 21 during the rest, filling and discharge modes, initially by the valve 43, then latterly by the plunger head 17. Accordingly, the fluid product 10 may be preservative-free, of particular benefit when the fluid product is a medicament.

The dispenser 1 further dispenses without the need for a dip tube, and gives no drain back.

Where the dispenser of the invention is a medicament dispenser, for instance an intra-nasal medicament dispenser, administration of the medicament may be indicated for the treatment of mild, moderate or severe acute or chronic symptoms or for prophylactic treatment.

Appropriate medicaments may thus be selected from, for example, analgesics, e.g., codeine, dihydromorphine, ergotamine, fentanyl or morphine; anginal preparations, e.g., diltiazem; antiallergics, e.g., cromoglycate (e.g. as the sodium salt), ketotifen or nedocromil (e.g. as the sodium salt); antiinfectives e.g., cephalosporins, penicillins, streptomycin, sulphonamides, tetracyclines and pentamidine; antihistamines, e.g., methapyrilene; anti-inflammatories, e.g., beclomethasone (e.g. as the dipropionate ester), fluticasone (e.g. as the propionate ester), flunisolide, budesonide, rofleponide, mometasone (e.g. as the furoate ester), ciclesonide, triamcinolone (e.g. as the acetonide), 6α, 9α-difluoro-11β-hydroxy-16α-methyl-3-oxo-17α-propionyloxy-androsta-1,4-diene-17β-carbothioic acid S-(2-oxo-tetrahydro-furan-3-yl) ester or 6α, 9α-Difluoro-17α-[(2 -furanylcarbonyl)oxy]-11β-hydroxy-16α-methyl-3-oxo-androsta-1,4-diene-17β-carbothioic acid S-fluoromethyl ester; antitussives, e.g., noscapine; bronchodilators, e.g., albuterol (e.g. as free base or sulphate), salmeterol (e.g. as xinafoate), ephedrine, adrenaline, fenoterol (e.g. as hydrobromide), formoterol (e.g. as fumarate), isoprenaline, metaproterenol, phenylephrine, phenylpropanolamine, pirbuterol (e.g. as acetate), reproterol (e.g. as hydrochloride), rimiterol, terbutaline (e.g. as sulphate), isoetharine, tulobuterol or 4-hydroxy-7-[2-[[2-[[3-(2-phenylethoxy)propyl]sulfonyl]ethyl]amino]ethyl-2(3H)-benzothiazolone; PDE4 inhibitors e.g. cilomilast or roflumilast; leukotriene antagonists e.g. montelukast, pranlukast and zafirlukast; [adenosine 2a agonists, e.g. 2R,3R,4S,5R)-2-[6-Amino-2-(1S-hydroxymethyl-2-phenyl-ethylamino)-purin-9-yl]-5-(2-ethyl-2H-tetrazol-5-yl)-tetrahydro-furan-3,4-diol (e.g. as maleate)]; [α4 integrin inhibitors e.g. (2S)-3-[4-({[4-(aminocarbonyl)-1-piperidinyl]carbonyl}oxy)phenyl]-2-[((2S)-4-methyl-2{[2-(2-methylphenoxy) acetyl] amino}pentanoyl)amino] propanoic acid (e.g. as free acid or potassium salt)], diuretics, e.g., amiloride; anticholinergics, e.g., ipratropium (e.g. as bromide), tiotropium, atropine or oxitropium; hormones, e.g., cortisone, hydrocortisone or prednisolone; xanthines, e.g., aminophylline, choline theophyllinate, lysine theophyllinate or theophylline; therapeutic proteins and peptides, e.g., insulin or glucagons. It will be clear to a person skilled in the art that, where appropriate, the medicaments may be used in the form of salts, (e.g., as alkali metal or amine salts or as acid addition salts) or as esters (e.g., lower alkyl esters) or as solvates (e.g., hydrates) to optimize the activity and/or stability of the medicament and/or to minimize the solubility of the medicament in the propellant.

Preferably, the medicament is an anti-inflammatory compound for the treatment of inflammatory disorders or diseases such as asthma and rhinitis.

The medicament may be a glucocorticoid compound, which has anti-inflammatory properties. One suitable glucocorticoid compound has the chemical name: 6α, 9α-Difluoro-17α-(1-oxopropoxy)-11β-hydroxy-16α-methyl-3-oxo-androsta-1,4-diene-17β-carbothioic acid S-fluoromethyl ester (fluticasone propionate). Another suitable glucocorticoid compound has the chemical name: 6α, 9α-difluoro-17α-[(2-furanylcarbonyl)oxy]-11β-hydroxy-16α-methyl-3-oxo-androsta-1,4-diene-17β-carbothioic acid S-fluoromethyl ester. A further suitable glucocorticoid compound has the chemical name: 6α,9α-Difluoro-11β-hydroxy-16α-methyl-17α-[(4-methyl-1,3-thiazole-5-carbonyl)oxy]-3-oxo-androsta-1,4-diene-17β-carbothioic acid S-fluoromethyl ester.

Other suitable anti-inflammatory compounds include NSAIDs e.g. PDE4 inhibitors, leukotriene antagonists, iNOS inhibitors, tryptase and elastase inhibitors, beta-2 integrin antagonists and adenosine 2a agonists.

The medicament is formulated as any suitable fluid formulation, particularly a solution (e.g. aqueous) formulation or a suspension formulation, optionally containing other pharmaceutically acceptable additive components. The formulation may contain a preservative, although the sealed system of the dispenser may negate the need for this.

The medicament formulation may incorporate two or more medicaments.

The dispenser herein is suitable for dispensing fluid medicament formulations for the treatment of inflammatory and/or allergic conditions of the nasal passages such as rhinitis e.g. seasonal and perennial rhinitis as well as other local inflammatory conditions such as asthma, COPD and dermatitis.

A suitable dosing regime would be for the patient to inhale slowly through the nose subsequent to the nasal cavity being cleared. During inhalation the formulation would be applied to one nostril while the other is manually compressed. This procedure would then be repeated for the other nostril. Typically, one or two inhalations per nostril would be administered by the above procedure up to three times each day, ideally once daily. Each dose, for example, may deliver 5 μg, 50 μg, 100 μg, 200 μg or 250 μg of active medicament. The precise dosage is either known or readily ascertainable by those skilled in the art.

It will be understood by the skilled reader in the art that the present invention is not limited to the embodiment herein described with reference to the FIGURES of drawings, but may be varied to adopt other guises within the scope of the appended claims. As an example, the dispenser of the invention need not be hand-held, nor hand-operable. Furthermore, the dispenser may be used to deliver any number of different fluid products, medicinal and non-medicinal, as outlined previously. Additionally, the dispenser may form an internal part of a device unit so that the dispenser delivers a metered volume of the fluid product to another internal part of the device unit. For instance, the unit may be a dispenser unit including the dispenser and the metered volume is delivered to conveying means in the dispenser unit which conveys the fluid product to an outlet orifice of the unit for discharge from the unit to the surrounding environment. The conveying means may be such as to change the state of the fluid, e.g. the conveying means may have a vibrating element, e.g. a mesh, which converts a metered volume of liquid to an aerosol or mist which is then directed out of the outlet orifice. The vibrating element could, for example, be a piezoelectric element or mesh.

The invention claimed is:

1. A dispenser for dispensing a metered volume of a fluid product having:

(a) a storage chamber for storing the fluid product;

(b) an outlet orifice through which the fluid product is dispensable from the dispenser;

(c) a metering chamber having:

(i) an outlet opening which places the metering chamber in fluid communication with the outlet orifice;

(ii) a transfer opening through which the fluid product is transferable between the storage and metering chambers; and (iii) a boundary wall structure which is cyclically movable between a first configuration, in which the transfer opening is opened, and a second configuration, in which the transfer opening is closed, each cycle of movement which commences at, and ends in, the second configuration resulting, when the fluid product is stored in the storage chamber, in a metered volume of the fluid product being transferred from the storage chamber to the metering chamber via the transfer opening and dispensed from the outlet orifice via the outlet opening; and (d) an actuation mechanism actuable by a user of the dispenser to cause a cycle of movement of the boundary wall structure, the actuation mechanism having a biasing structure which biases the boundary wall structure to the second configuration so that the boundary wall structure is disposed in the second configuration at the end of each cycle of movement caused by the actuation mechanism;

wherein the dispenser is adapted such that, when the fluid product is in the storage chamber, movement of the boundary wall structure in a first phase of the cycle of movement from the second configuration to the first configuration results in an excess volume of the fluid product, comprising the metered volume and a surplus volume, to be transferred from the storage chamber to the metering chamber and return movement of the boundary wall structure from the first configuration to the second configuration in a second phase of the cycle results in a bleed arrangement bleeding the surplus volume from the metering chamber and the metered volume being dispensed from the outlet orifice via the outlet opening;

wherein the actuation mechanism is manually operable;

wherein the actuation mechanism has an operating member which is engagable by a user to actuate the actuation mechanism; and wherein the actuation mechanism is actuated in response to depression of the operating member into the dispenser.

2. The dispenser of claim 1 in which the outlet opening is closed in the second configuration of the boundary wall structure.

3. The dispenser of claim 1 wherein the first and second configurations are expanded and contracted configurations, respectively.

4. The dispenser of claim 3 wherein the metering chamber defines a first internal volume in the expanded configuration and a second internal volume, which is less than the first internal volume, in the contracted configuration.

5. The dispenser of claim 4 wherein the second internal volume is zero or substantially zero.

6. The dispenser of claim 1 wherein the boundary wall structure has first and second wall structures movable relative to one another, the second wall structure being disposed in a first position relative to the first wall structure in the first configuration and in a second position relative to the first wall structure in the second configuration, the second position being closer to the first wall structure than the first position.

7. The dispenser of claim 6 wherein the first and second wall structures bear against one another in the second configuration.

8. The dispenser of claim 6 in which the outlet opening is provided in the first wall structure.

9. The dispenser of claim 6 wherein the second wall structure sealingly closes the outlet opening in the second position.

10. The dispenser of claim 6 wherein the outlet opening is provided in a section of the first wall structure against which the second wall structure bears when in the second position.

11. The dispenser of claim 10 in which the first wall structure section is of complementary form to a section of the second wall structure, said sections bearing against one another in the second position.

12. The dispenser of claim 6 wherein the first and second wall structures are movable relative to one another between the first and second positions in a forward-rearward direction.

13. The dispenser of claim 12 wherein the second wall structure forms a rear end of the metering chamber.

14. The dispenser of claim 12 in which the first wall structure forms a forward end of the metering chamber which has the outlet opening therein.

15. The dispenser of claim 13 wherein the rear end is of a complementary shape to that of the forward end and bears against the forward end in the second position.

16. The dispenser of claim 12 wherein the first wall structure has a side section which extends generally in the forward-rearward direction, and the second wall structure is sealingly, slidably movable on the side section between the first and second positions.

17. The dispenser of claim 16 wherein the side section extends rearwardly from the forward end.

18. The dispenser of claim 6 wherein the second wall structure is presented by a plunger.

19. The dispenser of claim 1, wherein the boundary wall structure has first and second wall structures moveable relative to one another, the second wall structure being disposed in a first position relative to the first wall structure in the first configuration and in a second position relative to the first wall structure in the second configuration, the second position being closer to the first wall structure than the first position, and wherein the biasing mechanism biases the second wall structure to the second position relative to the first wall structure.

20. The dispenser of claim 1 further having a one-way valve which is positioned in a dispensing direction relative to the outlet opening and which only permits fluid flow therethrough in the dispensing direction.

21. The dispenser of claim 1 in which the operating member is finger-operable by the user.

22. The dispenser of claim 1 wherein the actuation mechanism is moved from a rest condition to an actuated condition on actuation thereof.

23. The dispenser of claim 22 having a biasing structure which biases the actuation mechanism to the rest condition.

24. The dispenser of claim 22 adapted such that at the end of each cycle of movement of the boundary wall structure the actuation mechanism is returned to its rest condition.

25. The dispenser of claim 1 wherein the biasing structure biases the operating member outwardly.

26. The dispenser of claim 1 in which the outlet orifice is in a nozzle adapted for insertion into a nostril of a user and through which the dispenser, in use, dispenses.

27. The dispenser of claim 1 which is hand-held.

28. The dispenser of claim 1, wherein the bleed arrangement is configured to bleed the surplus volume back to the storage chamber.

29. The dispenser of claim 28 adapted such that the surplus volume is bled back to the storage chamber via the transfer opening.

30. The dispenser of claim 1 containing the fluid product.

31. The dispenser of claim 30 in which the fluid product is a medicament.

32. The dispenser of claim 19, wherein the first and second wall structures are movable relative to one another between the first and second positions in a forward-rearward direction with movement from the first to the second position being effected by forward movement of the second wall structure relative to the first wall structure and wherein the second wall structure is presented by a forward end of a plunger and forms a rear end of the metering chamber.

33. The dispenser of claim 32, further having a one-way valve which is positioned in a dispensing direction relative to the outlet opening and which only permits fluid flow therethrough in the dispensing direction and wherein the plunger is arranged to move relative to the valve.

34. The dispenser of claim 33, wherein the valve is on the first wall structure.

35. The dispenser of claim 33, wherein the valve has an opening pressure threshold and the dispenser is adapted such that the opening pressure threshold is only met when the plunger moves the second wall structure forwardly relative to first wall structure from the first to the second position.

36. The dispenser of claim 20 configured and arranged such that, when fluid product is stored in the storage chamber, each cycle of movement of the boundary wall structure of the metering chamber results in the metered volume of the fluid product being dispensed through the one-way valve.

37. The dispenser of claim 1, wherein the storage chamber stores a fluid product which is a medicament.

* * * * *